US006850231B2

(12) United States Patent
Oh

(10) Patent No.: US 6,850,231 B2
(45) Date of Patent: Feb. 1, 2005

(54) ORGANIC ELECTROLUMINESCENT DISPLAY CONTROL SYSTEM

(75) Inventor: Choon Yul Oh, Kunpo (KR)

(73) Assignee: Samsung SDI Co., Ltd., Suwon-si (KR)

( * ) Notice: Subject to any disclaimer, the term of this patent is extended or adjusted under 35 U.S.C. 154(b) by 251 days.

(21) Appl. No.: 10/014,792

(22) Filed: Dec. 14, 2001

(65) Prior Publication Data

US 2002/0109651 A1 Aug. 15, 2002

(30) Foreign Application Priority Data

Jan. 2, 2001 (KR) ..... 2001-0000006

(51) Int. Cl.[7] ..... G09G 3/30; G09G 5/36

(52) U.S. Cl. ..... 345/204; 76/649; 76/574

(58) Field of Search ..... 345/76–80, 204, 345/564, 571, 574, 649, 656, 658, 659

(56) References Cited

U.S. PATENT DOCUMENTS 5,661,632 A * 8/1997 Register ..... 361/683
5,678,035 A * 10/1997 Takebe ..... 345/554
5,936,619 A * 8/1999 Nagasaki et al. ..... 345/205
6,208,325 B1 * 3/2001 Reddy et al. ..... 345/658
6,611,260 B1 * 8/2003 Greenberg et al. ..... 345/204

* cited by examiner

*Primary Examiner*—Regina Liang
*Assistant Examiner*—Duc Q Dinh
(74) *Attorney, Agent, or Firm*—Staas & Halsey LLP

(57) ABSTRACT

An organic electroluminescent EL display control system includes a display panel having a common terminal arranged on a lower portion thereof and a segment terminal arranged on a side portion thereof, and a driver controller having the driver controller including a display RAM storing data, the data being vertically read from the display RAM.

11 Claims, 6 Drawing Sheets

DISPLAY PANEL
40
TURNING UP

DISPLAY PANEL
40

D0
page 2
D7
D0
page 1
D7
D0
page 0
D7
DISPLAY RAM
44

D7
page 2
D0
D7
page 1
D0
D7
page 0
D0
DISPLAY RAM
44

ORGANIC ELECTROLUMINESCENT DISPLAY CONTROL SYSTEM

CROSS-REFERENCE TO RELATED APPLICATIONS

This application claims the benefit of Korean Patent Application No. 2001-6 filed on Jan. 2, 2001, under 35 U.S.C. §119, the entirety of which is hereby incorporated by reference.

BACKGROUND OF THE INVENTION

1. Field of the Invention

The present invention relates to an organic electroluminescent (hereinafter EL) device, and more particularly, to an organic EL display control system.

2. Description of Related Art

FIG. 1 is a schematic block diagram illustrating a typical display control system. As shown in FIG. 1, the display control system, to be used with, for example, a cellular phone, includes a display panel 10 and a driver controller 20. The display panel 10 includes a common terminal and a segment terminal. The driver controller 20 includes a common driver circuit 21, a segment driver circuit 22, a display RAM 23, a page address generating circuit 24, a data latch circuit 25, a line address generating circuit 26, a column address generating circuit 27, and a controller 28. At this point, the display RAM 23 has a cell matrix of 24-bit×24-bit as an example, and therefore, the data latch circuit 25 is a 24-bit data latch circuit.

The common driver circuit 21 is connected to the common terminal of the display panel 10 to be used as a scanning unit to scan a display region of the display panel, and the segment driver circuit 22 is connected to the segment terminal of the display panel 10 to be used as a data transmission unit. The page address generating circuit 24 is connected to the display RAM 23 through address buses and serves to designate a page address during a write operation. The data latch circuit 25 is connected to the display RAM 23 through data buses so that 24-bit data of a row may be output from the display RAM 23 at a time during a read operation. The line address generating circuit 26 is connected to the display RAM 23 through address buses (not shown) and serves to designate or select a row to be displayed during a read operation. The column address generating circuit 27 is connected to the display RAM 23 through address buses (not shown) and serves to designate a column address during a write operation. The controller 28 serves to control all components of the driver controller 20.

The display control system having such a configuration has common lines on right and left hands of the display panel 10 and segment lines on a lower portion of the display panel 10, and therefore, the driver controller 20 is designed to satisfy such an arrangement. Therefore, the driver controller 20 is further away from the common terminal than from the segment terminal.

Meanwhile, there are organic EL devices in which the common terminal is changed in position with the segment terminal because a driving voltage and power consumption are improved.

FIG. 2 is a schematic block diagram illustrating a conventional organic EL display control system. As shown in FIG. 2, except for the fact that the common terminal is changed in position with the segment terminal, the conventional organic EL display control system has the same configuration and arrangement as the display control system of FIG. 1.

Hereinafter, an operation of the organic EL display control system is explained in detail with reference to FIGS. 1 and 2.

First, for the write operation, a page address and a column address of the RAM 23 are designated through the page address generating circuit 24 and the column address generating circuit 27, respectively. In FIG. 2, the page address is designated as "0", and the column address is designated as "2". The display RAM 23 is configured so that data of 8 lines corresponding to one column (i.e., 8-bit data) may be written at a time. The controller 28 writes 8-bit data at a time on the designated page address and the designated column address, i.e., a page "0" and a column 2. In other words, when 8-bit data is transferred and a write command is received, 8-bit data is written at a time on the page "0" and the column 2 of the display RAM 23, and then the column address is as increased by "1", automatically. Thereafter, when 8-bit data is transferred and a write command is received, 8-bit data is written on the page "0" and the column 3 of the display RAM 23. In the same way, in response to the write commands of 3×24 times, a content of the display RAM 23 is newly changed.

Then, for the read operation, the controller 28 controls the common driver circuit 21 and the segment driver circuit 22 to display data stored in the display RAM 23 on the display panel 10. More specifically, the controller 28 designates a line address through the line address generating circuit 26 and thereafter stores 24-bit data of a designated row at a time in the 24-bit data latch circuit 25. In FIG. 2, an $18^{th}$ row is designated. The controller 28 sends a signal so that the common driver circuit 21 may scan the designated row (i.e., the $18^{th}$ row ) of the display panel 10 so that 24-bit data in the 24-bit latch circuit 25 may be applied to the display panel 10 through the segment driver circuit 22. That is, when the common driver circuit 21 scans the $18^{th}$ row of the display panel 10, the data latch circuit 25 latches the 24-bit data of the $18^{th}$ row and outputs this data through the segment driver circuit 22 to the display panel 10.

FIG. 3A shows a display state when the display data are displayed in the typical display control system of FIG. 1, and FIG. 3B shows a display state when the display data are displayed in the conventional organic EL display control system of FIG. 2. In FIGS. 3A and 3B, a portion of the display data defined by a dotted line represents the 24-bit data of the $18^{th}$ row.

As shown in FIG. 3A, in the case of the display control system of FIG. 1, the display data is horizontally, i.e., properly, displayed. However, as shown in FIG. 3B, in case of the organic EL display control system of FIG. 2, the display data is vertically displayed on the display panel 10. That is, the display data is displayed in a vertical form because the common terminal is changed in position with the segment terminal. In other words, in the typical display control system of FIG. 1, the segment driver circuit 22 is connected to the segment terminal arranged on a lower portion, and thus the display data is horizontally applied to the display panel 10. However, in the conventional organic EL display control system of FIG. 2, the segment driver circuit 22 is connected to the segment terminal arranged on a side portion of the display panel 10, and thus the display data is vertically applied to the display panel 10. As a result, the display data to be horizontally displayed is vertically displayed.

In order to overcome the above problems, display data should be output from the display RAM 23 and then applied to the display panel 10 in consideration of an output form of the display data from the display RAM 23 and a position of the segment terminal in the display panel 10.

If data stored in the display RAM 23 are textures, the display data can properly be displayed by changing software or algorithms. However, if data written on the display RAM 23 are images of, for example, a videophone, since images should be properly turned, it is a very heavy task to change software or algorithms of images. In addition, in order to properly display image data, not only should the software be changed, but also hardware components such as a buffer RAM should be added.

SUMMARY OF THE INVENTION

Accordingly, it is an object of the present invention to provide an organic EL display control system that can properly display data without changing the software or adding hardware, while improving a driving voltage and power consumption.

Additional objects and advantages of the invention will be set forth in part in the description which follows and, in part, will be obvious from the description, or may be learned by practice of the invention.

The foregoing and other objects of the present invention are achieved by providing an organic EL display control system. The organic EL display control system includes a display panel having a common terminal arranged on a lower portion thereof and a segment terminal arranged on a side portion thereof, and a driver controller having a display RAM storing data, the data being vertically read from the display RAM. The common terminal of the display panel is connected to a common driver circuit of the driver controller, and the segment terminal of the display is connected to a segment driver circuit of the driver controller. Alternative positioning of the common terminal and the segment terminal with respect to their placement on the display panel will provide the desired results. However, it is desirable to have a shorter line length between the common driver circuit and the common terminal than a line length between the segment driver circuit and the segment terminal.

The driver controller according to an embodiment of the invention comprises: the common driver circuit connected with the common terminal of the display panel; the segment driver connected with the segment terminal of the display panel; a page address generating circuit connected with the display RAM through address buses and designating a page address during a write operation; a data latch circuit connected with the display RAM through data buses so that the data of a column may be output from the display RAM at a time during a read operation; a line address generating circuit connected with the display RAM through address buses and designating the column to be displayed during a read operation; a column address generating circuit connected with the display RAM through address buses and designating a column address during a write operation; and a controller controlling all components of the driver controller.

According to an aspect of the invention, a line length between the common driver circuit and the common terminal is shorter than a line length between the segment driver circuit and the segment terminal.

In the organic EL display control system having the display panel in which the segment terminal is arranged on a side portion thereof, since the data written in the display RAM is vertically read, the display data can properly be displayed without changing software or adding hardware while improving a driving voltage and power consumption.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENTS

Reference will now be made in detail to preferred embodiments of the present invention, example of which is illustrated in the accompanying drawings.

Figure 1:
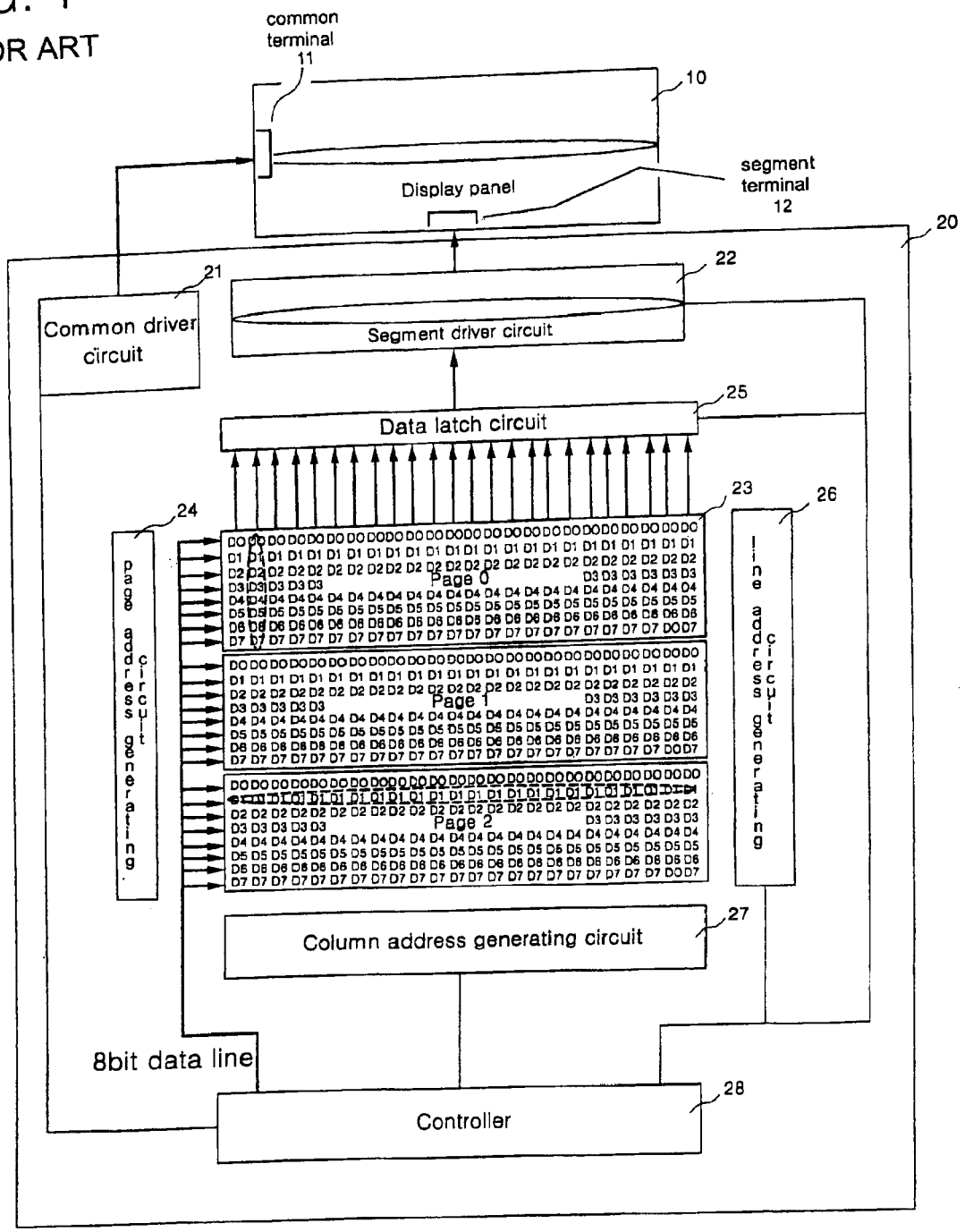
FIG. 1 PRIOR ART
FIG. 1 is a schematic block diagram illustrating a typical display control system.
Figure 2:
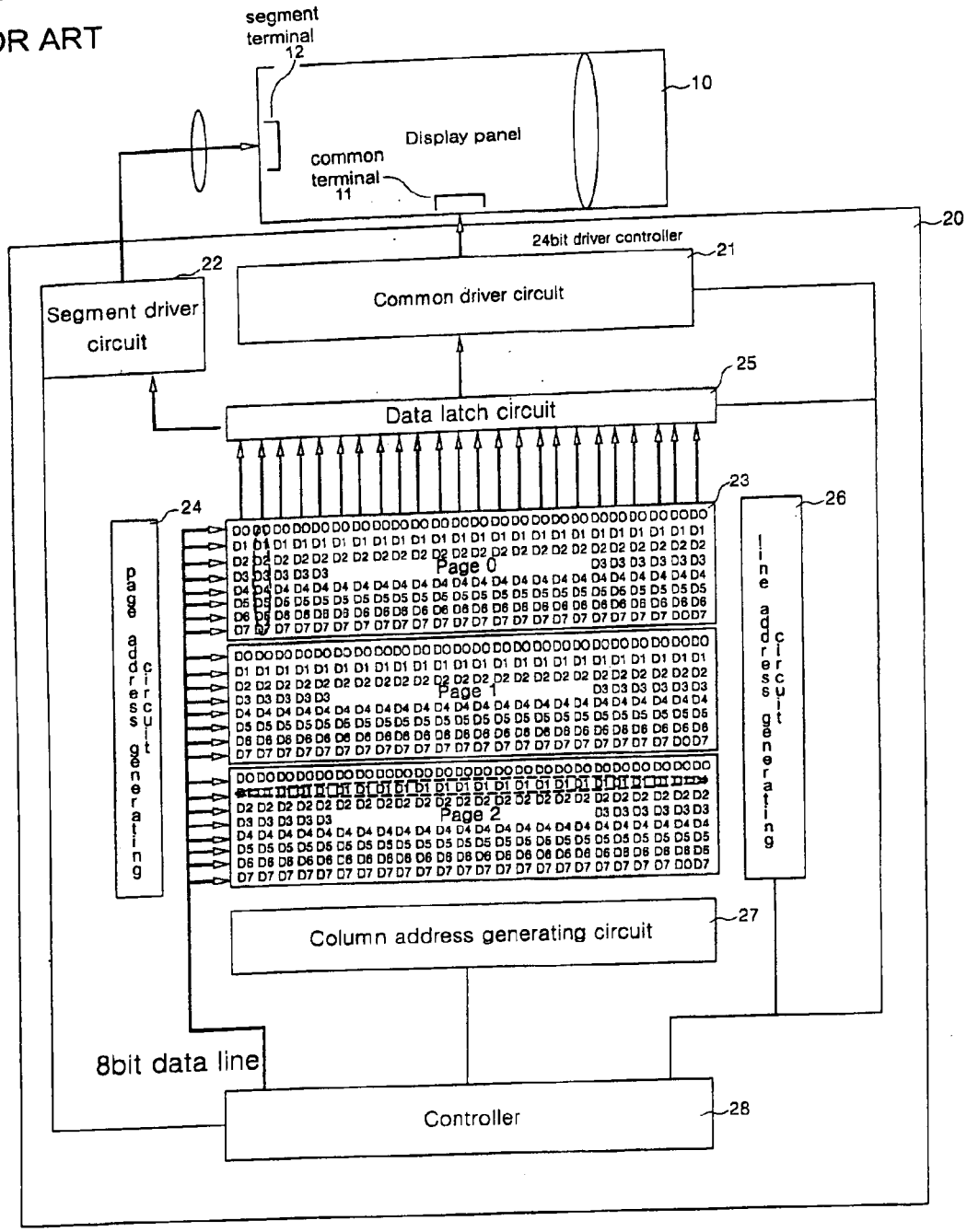
FIG. 2 PRIOR ART
FIG. 2 is a schematic block diagram illustrating a conventional organic EL display control system.
Figure 3A:
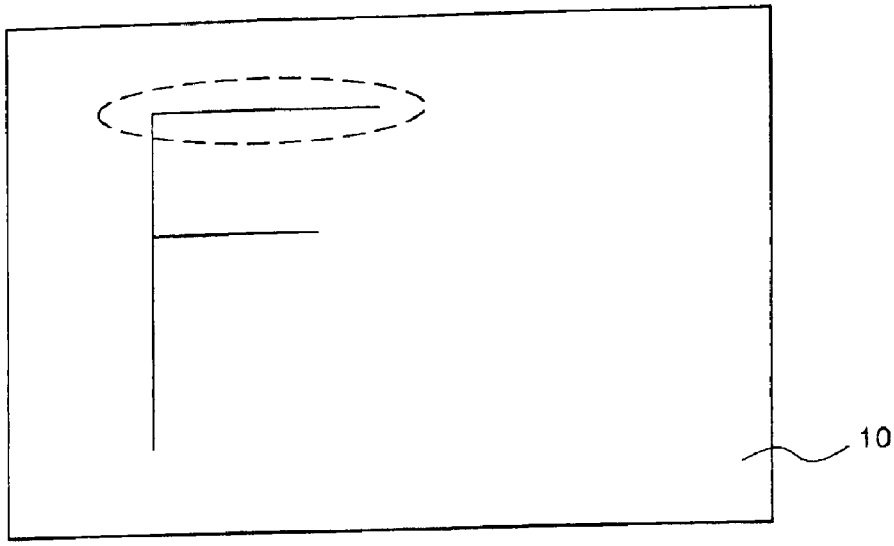
FIG. 3A PRIOR ART
FIG. 3A is a view illustrating a display state in which data is displayed in the typical display control system of FIG. 1.
Figure 3B:
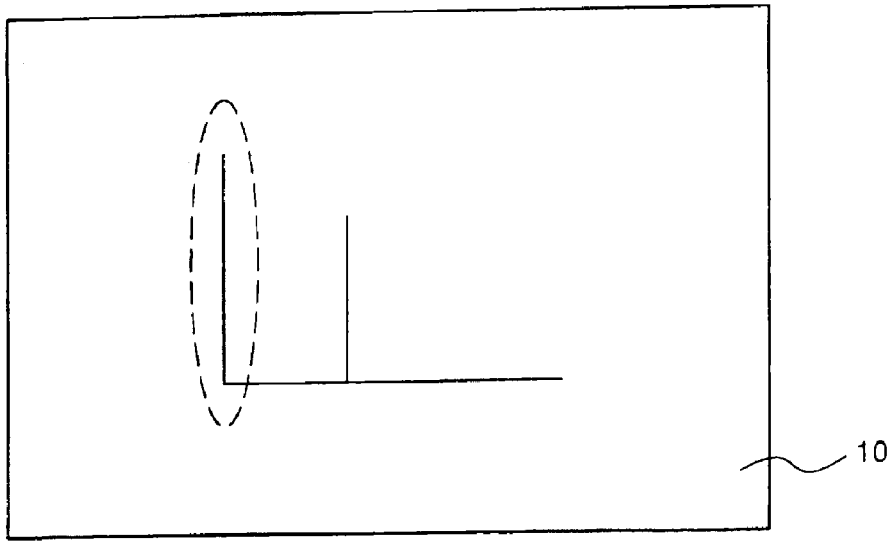
FIG. 3B PRIOR ART
FIG. 3B is a view illustrating a display state in which data is displayed in the conventional organic EL display control system of FIG. 2.
Figure 4:
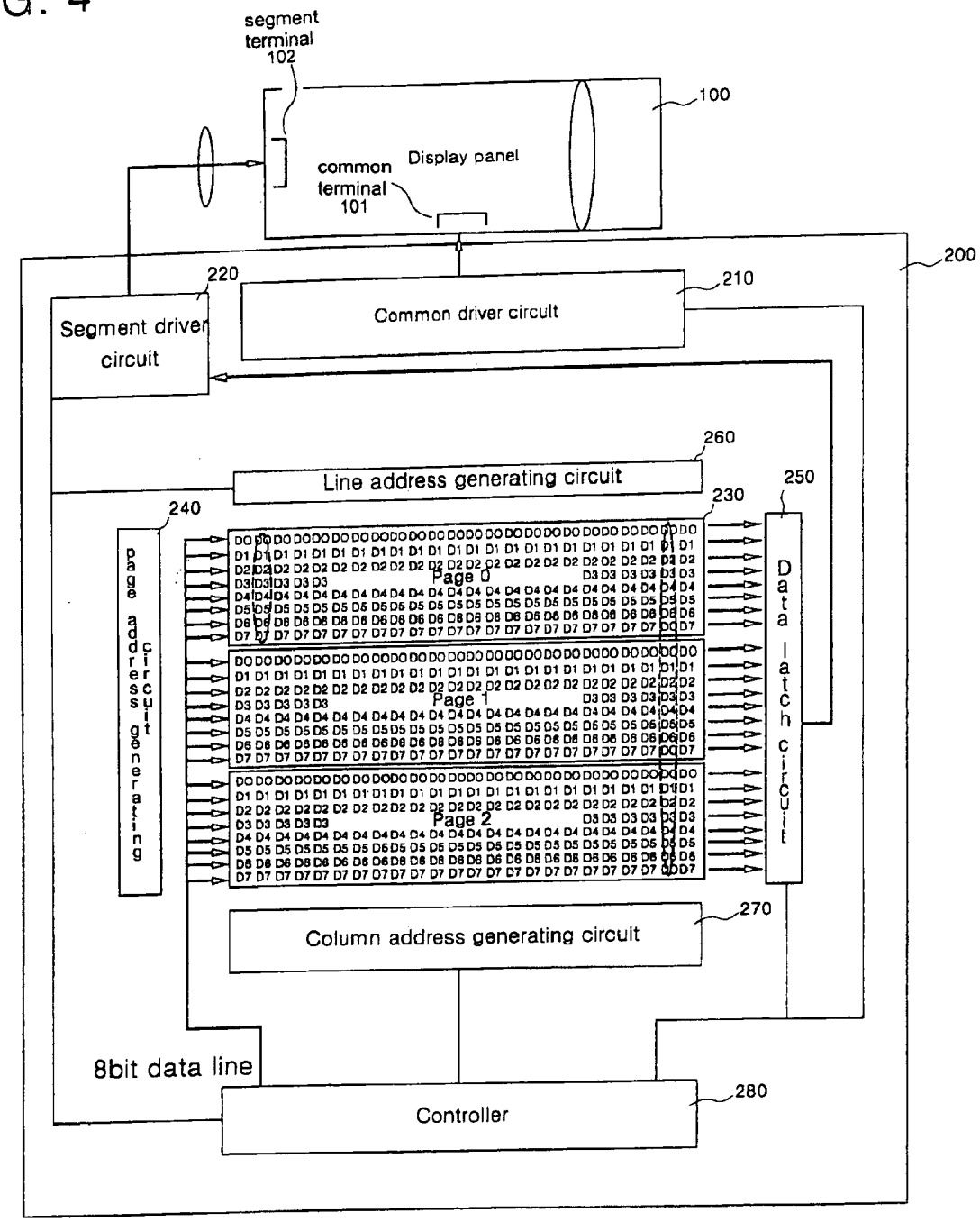
FIG. 4 is a schematic block diagram illustrating an organic EL display control system according to an embodiment of the present invention.

FIG. 4 is a schematic block diagram illustrating an organic EL display control system according to an embodiment of the present invention. As shown in FIG. 4, the organic EL display control system to be used with, for example, a cellular phone, includes a display panel 100 and a driver controller 200. The display panel 100 includes a common terminal 101 and a segment terminal 102. The common terminal 101 is connected to a plurality of scan lines (not shown) arranged in a longitudinal direction and spaced apart from each other, and the segment terminal 102 is connected to a plurality of data lines (not shown) arranged in a transverse direction perpendicular to the scan lines. The driver controller 200 includes a common driver circuit 210, a segment driver circuit 220, a display RAM 230, a page address generating circuit 240, a data latch circuit 250, a line address generating circuit 260, a column address generating circuit 270, and a controller 280. Here, as an example only, the display RAM 230 has a cell matrix of 24-bit×24-bit matrix, and therefore, the data latch circuit 250 in this example is a 24-bit data latch circuit. It is to be noted that the display RAM of the present invention is not limited to the dimensions provided in the above example, but instead may have any number of dimensions which provide the desired results sought in the present invention.

The common driver circuit 210 is connected to the common terminal 101 arranged on a lower portion of the display panel 100 and performs scanning of a display region, and the segment driver circuit 220 is connected to the segment terminal 102 arranged on a side portion of the display panel 100 and performs data transmission. Note that the positioning of the common terminal 101 and the segment terminal 102, with respect to being located at the lower portion and the side portion of the display panel, may be alternated providing that a line length between the common terminal 101 and the driver controller 200 is shorter than the line length between the segment terminal 102 and the driver controller 200. The page address generating circuit 240 is connected to the display RAM 230 through address buses (not shown) and serves to designate a page address during a write operation. The data latch circuit 250 is connected to the display RAM 230 through data buses so that 24-bit data of a column may be output from the display RAM 230 at a time during a read operation. The line address generating circuit 260 is connected to the display RAM 230 through address buses (not shown) and serves to designate or select a column to be displayed during a read operation. The column address generating circuit 270 is connected to the display RAM 230 through address buses (not shown) and serves to designate a column address during a write operation. The controller 280 serves to control all components of the driver controller 200. In FIG. 4, arrows pointing into the display RAM 230 denote data lines providing for data to be written to the RAM 230. These data lines extend from an 8-bit data line that is connected to the controller 280, providing for 8-bit data to be written to the display RAM 230 at a time.

That is, since the segment driver circuit 220 is connected to the segment terminal arranged, for example, on a side portion of the display panel 100, the data latch circuit 250 is connected to the display RAM 230 so that 24-bit data may be vertically output. In other words, the 24-bit data output from the display RAM 230 is output in a column form.

Hereinafter, an operation of the organic EL display control system of FIG. 4 is explained in detail.

First, for the write operation, a page address and a column address are designated through the page address generating circuit 240 and the column address generating circuit 270, respectively. In FIG. 4, an illustration is provided in which the page address is designated as "0" and the column address is designated as "2". The display RAM 230 is configured so that data of 8 lines corresponding to one column (i.e., 8-bit data) may be written at a time. The controller 280 writes 8-bit data at a time on the designated page address and the designated column address, i.e., a page "0" and a column 2. In other words, when 8-bit data is transferred and a write command is received, 8-bit data is written on the page "0" and the column 2 of the display RAM 230 at a time, and the column address is then increased by "1", automatically. Thereafter, when 8-bit data is transferred and a write command is received, 8-bit data is written on the page 0 and the column 3 of the display RAM 230. In the same way, in response to the write commands of 3×24 times, a content of the display RAM 230 is newly changed.

Then, for the read operation, the controller 280 controls the common driver circuit 210 and the segment driver circuit 220 to display data stored in the display RAM 230 on the display panel 100. More specifically, the controller 280 designates a line address through the line address generating circuit 260 and thereafter stores 24-bit data of a designated column at a time in the 24-bit data latch circuit 250. In FIG. 4, a $23^{rd}$ column is designated. The controller 280 sends a signal so that the common driver circuit 210 may scan the designated column (i.e., the $23^{rd}$ column ) of the display panel 100 so that 24-bit data in the 24-bit latch circuit 250 may be applied to the display panel 100 at the designated column through the segment driver circuit 220. That is, when the common driver circuit 210 scans the $23^{rd}$ column of the display panel, the data latch circuit 250 latches the 24-bit data of the $23^{rd}$ column and outputs this data to the segment driver circuit 220, which in turn outputs this data to the display panel 100.

Figure 5:
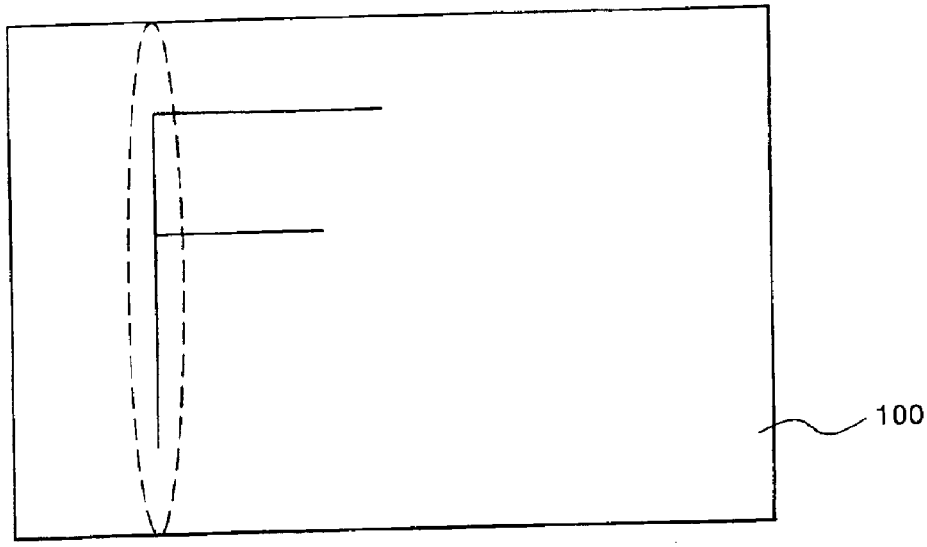
FIG. 5 is a view illustrating a display state in which letter data is displayed in the organic EL display control system of FIG. 4.

FIG. 5 is a view illustrating a display state in which letter data are displayed in the organic EL display control system of FIG. 4. In FIG. 5, a portion of the display data defined by a dotted line represents the 24-bit data of the $23^{rd}$ column. As shown in FIG. 5, since the 24-bit data are vertically output from the display RAM 230, the display data is vertically, i.e., properly displayed on the display panel 100.

FIGS. 6A to 6D are views illustrating a method of turning up display image data in the organic EL display control system according to an embodiment of the present invention. In the organic EL display control system according to this embodiment, image data is also properly displayed without changing an algorithm or adding hardware.

Figures 6A, 6B, 6C, 6D:
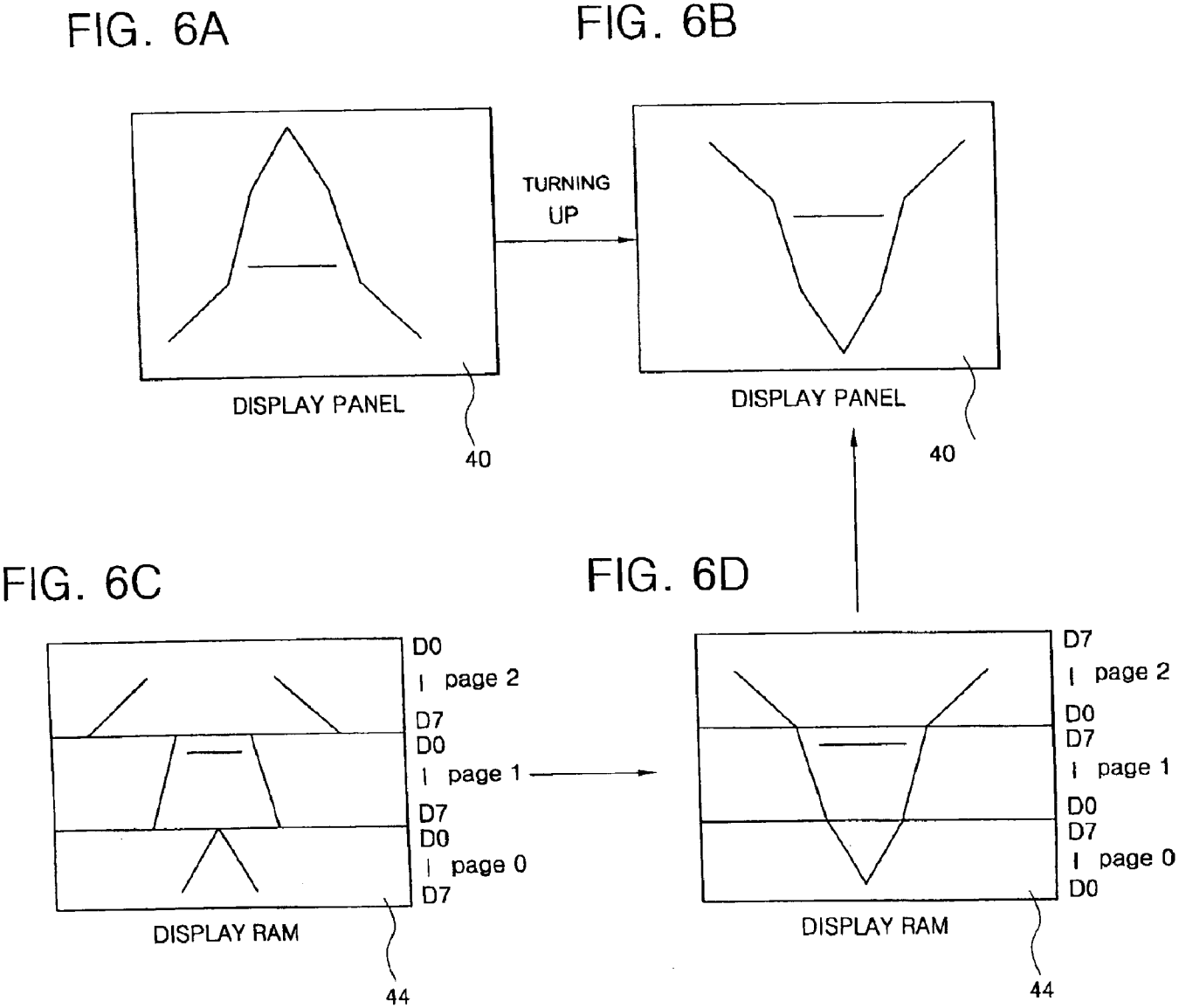
FIGS. 6A to 6D are views illustrating a method of turning up display image data in the organic EL display control system of FIG. 4.

In order to turn up the display image data of FIG. 6A as illustrated in FIG. 6B, the page addresses are conversely designated, and the data buses of the data latch circuit 250 are also conversely connected to pins of the display RAM 230. If only the page addresses are conversely designated, broken image data is displayed on the display panel 100, as shown in FIG. 6C.

In other words, as shown in FIG. 6C, if the page addresses are designated in order of page 2, page 1 and page 0, the image data that are turned up becomes broken. However, if the page addresses are designated in order of page 2, page 1 and page 0, and the data buses of the data latch circuit 250 are connected to the pins of the display RAM 230 in such a way that an address D7 is connected with a pin D0, D6 with D1, . . . , D0 with D7, the image data that are turned up are properly displayed. This matching of conversely connected pins to turn up the data image is illustrated in FIG. 6D.

Instead of the method of changing a connection of the pins of the data latch circuit 250, in order to turn up the display image data of FIG. 6A as illustrated in FIG. 6B, a method can be used in which a connection of pins of the 8-bit data line connected to the controller 280 is changed from an order of "0, . . . , 7" to an order of "7, . . . , 0", as illustrated in FIG. 6D.

As described herein before, in the organic EL display control system having the display panel in which the segment terminal is arranged on a side portion thereof, since the data written in the display RAM are vertically read, the display data can properly be displayed without changing any software or adding hardware while improving a driving voltage and power consumption.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An organic EL display control system comprising:

a display panel including data lines and scan lines, the data lines arranged in a transverse direction, the scan lines arranged in a perpendicular direction to the data lines; and a driver controller having a display RAM storing data;

wherein the data is vertically written on and vertically read from the display RAM, and the read data is transmitted to the display panel.

2. The system of claim 1, wherein the driver controller further comprises:

a common driver circuit connected to the scan lines of the display panel;

a segment driver circuit connected to the data lines of the display panel, a page address generating circuit connected to the display RAM through address buses and designating vertically a page address to store the data during a write operation;

a data latch circuit connected to the display RAM through data buses so that the data of a column is output from the display RAM at a time during a read operation;

a line address generating circuit connected to the display RAM through address buses and designating the column to be displayed during a read operation;

a column address generating circuit connected to the display RAM through address buses and designating a column address during a write operation; and a controller controlling each of the common driver circuit, the segment driver circuit, the page address generating circuit, the data latch circuit, the line address generating circuit, and the column address generating circuit.

3. The system of claim 1, wherein a line length between the common driver circuit and the scan lines is shorter than that between the segment driver circuit and the data lines.

4. The system of claim 1, wherein the data is an image, and the image is turned up by conversely changing a connection order of pins of an input side of the display RAM.

5. The system of claim 1, wherein the data is an image, and the image is turned up by conversely changing a connection order of pins of an output side of the display RAM.

6. The system of claim 2, wherein a line length between the common driver circuit and the scan lines is shorter than that between the segment driver circuit and the data lines.

7. An organic EL display control system, comprising:

a display panel including a segment terminal and a common terminal, the segment terminal connected to data lines, the common terminal connected to scan lines arranged in a perpendicular direction to the data lines;

a driver controller having a display RAM storing data and outputting the data from the display RAM in the same direction as a longitudinal direction of the scan lines; and wherein the data is vertically written on and vertically read from the display RAM; and wherein a line length between the common terminal and the driver controller is shorter than that between the segment terminal and the driver controller.

8. The system of claim 7, wherein the data lines are arranged in a transverse direction, and the scan lines are arranged in a vertical direction.

9. The system of claim 7, wherein the driver controller comprises:

a common driver circuit connected to the common terminal of the display panel;

a segment driver circuit connected to the segment terminal of the display panel;

a page address generating circuit connected to the display RAM through address buses and designating vertically a page address to store the data during a write operation;

a data latch circuit connected to the display RAM through data buses so that the data of a column is output from the display RAM at a time during a read operation;

a line address generating circuit connected to the display RAM through address buses and designating the column to be displayed during a read operation;

a column address generating circuit connected to the display RAM through address buses and designating a column address during a write operation; and a controller controlling each of the common driver circuit, the segment driver circuit, the page address generating circuit, the data latch circuit, the line address generating circuit, and the column address generating circuit.

10. The system of claim 7, wherein the data is an image, and the image is turned up by conversely changing a connection order of pins of an output side of the display RAM.

11. The system of claim 9, wherein a line length between the common driver circuit and the common terminal is shorter than that between the segment driver circuit and the segment terminal.

* * * * *